United States Patent [19]

Ku et al.

[11] 4,341,102

[45] Jul. 27, 1982

[54] CONSTRUCTION FOR A CYLINDER LOCK AND KEY

[76] Inventors: Chung C. Ku, 63, Cheng Chou Rd.; Ching H. Yeh, 76, Hsin Yi Rd., both of Taipei, Taiwan

[21] Appl. No.: 79,463

[22] Filed: Sep. 27, 1979

Related U.S. Application Data

[63] Continuation-in-part of Ser. No. 919,040, Jun. 26, 1978, abandoned, which is a continuation-in-part of Ser. No. 797,065, May 16, 1977, abandoned.

[51] Int. Cl.[3] ..... E05B 27/06

[52] U.S. Cl. ..... 70/358; 70/421

[58] Field of Search ..... 70/358, 419, 421, 386, 70/364 A

[56] References Cited

U.S. PATENT DOCUMENTS

| | | | |
|---|---|---|---|
| 913,942 | 3/1909 | Bodge | 70/386 |
| 3,348,392 | 10/1967 | Schreiber . | |
| 3,507,133 | 4/1970 | Bassecher . | |
| 3,656,328 | 4/1972 | Hughes . | |
| 4,012,931 | 3/1977 | Harunari | 70/386 |

*Primary Examiner*—Robert L. Wolfe

*Attorney, Agent, or Firm*—Tak Ki Sung

[57] ABSTRACT

The invention relates to an improved construction for a cylinder lock and key, more particularly to a cylinder lock which has a plurality of pin tumblers of different lengths and diameters arranged radially about the axis of a rotatable cylinder, a pin tumbler longitudinally provided at the rear end of a stationary cylinder, a ball being further provided between said rotatable cylinder and stationary cylinder, and a matching key which comprises a tubular shank having thereon a plurality of depressions corresponding to said radially arranged pin tumblers.

1 Claim, 4 Drawing Figures

CONSTRUCTION FOR A CYLINDER LOCK AND KEY

CROSS REFERENCE TO RELATED APPLICATIONS

This application is a continuation-in-part application of Ser. No. 919,040, filed June 26, 1978, which is a continuation-in-part application of Ser. No. 797,065, filed May 16, 1977, both now abandoned.

BACKGROUND OF THE INVENTION

Cylinder locks are generally comprised of a stationary housing and a rotatably mounted plug or cylinder and a plurality of pin tumblers of various lengths comprising an upper and lower segment which are pressed down from cavities provided in the housing by springs to engage with holes in the cylinder, thus preventing the latter from rotating. Upon insertion of a properly cut key each pin tumbler is raised so that the top of the lower segment is flush with the top of the cylinder, allowing the segments to separate and the cylinder to be turned in the housing.

However, to date all such cylinder locks employ pin tumblers which are laterally spaced along a single line running parallel with the axis of the cylinder and may be raised only by using a generally long, flat key provided with a plurality of irregular teeth and alternating indentations along a single edge thereof. For this reason, the number of pin tumblers which may be used and the variations of alternative heights of said pin tumblers within the cylinder are extremely limited.

Another disadvantage of such cylinder locks which can generally accommodate only from four to six laterally spaced pin tumblers is that due to the lateral arrangement of the several pin tumblers, the lock becomes very susceptible to unauthorized "picking" or opening without the use of the proper key.

In addition, the flat key can be placed in the slot-like opening of the cylinder in only one way, which can be very frustrating for children and especially irritating when trying to unlock a door in an unlighted or poorly lit area where the exact position of the slot is not readily ascertainable.

Furthermore, as the flat key can be inserted only in one position, there is much wear on the toothed face of the key, causing the lock to "stick" and generally become harder to open as time goes on.

Also, the flat key is very susceptible to breakage after being inserted into the cylinder, often necessitating the complete replacement of the entire lock.

Another disadvantage of the flat key is that there are many sharp edges which may prove hazardous to children and which occasionally cause tears in pockets and clothing.

SUMMARY OF THE INVENTION

It is a purpose of the present invention to improve upon the above said defects and to provide an improved cylinder lock and key which are adapted to provide smooth operation and easy insertion of said key into the cylinder with a minimum of wear to the surface of the key to provide for a longer useful life thereof.

It is another purpose of the present invention to provide a cylinder lock wherein a greatly increased number of pin tumblers may be employed and which are arranged in rows spaced radially from the center axis of the cylinder.

It is a further object of the present invention to provide a lock wherein one of the pin tumblers is longitudinally dispersed at the rear end of the stationary cylinder and a ball is provided between the rotatable cylinder and a ball is provided between the rotatable cylinder and the stationary cylinder whereby the lock is much less likely to be successfully picked or opened by means other than a matching key.

It is yet another purpose of the present invention to provide a key which is sturdy and relatively less susceptible to breakage and which has a minimum of sharp edges.

BRIEF DESCRIPTION OF THE DRAWING

Other purposes and advantages of the present invention will become obvious as the invention is now described in detail with reference to the appended drawings, wherein.

DETAILED DESCRIPTION OF THE INVENTION

Figure 1:
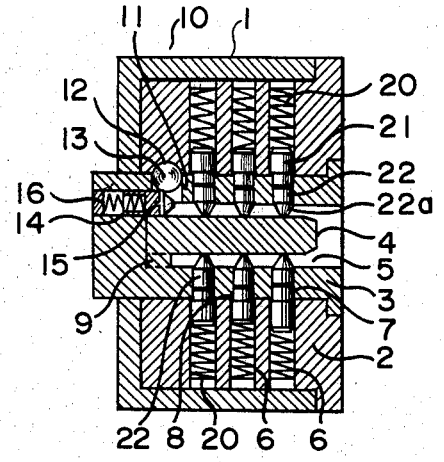
FIG. 1 is a view in longitudinal section showing a cylinder lock according to the present invention.

As shown in the accompanying drawings, the present invention relates to a cylinder lock 10 and a matching key 17. Lock 10 is comprised of a housing 1 in which is provided a hollow stationary cylinder 2. The stationary cylinder 2 is provided with a plurality of bores 6 therethrough, the longitudinal axes of which are arranged radially from the central axis of the stationary cylinder 2. Inside the hollow portion of the stationary cylinder 2 is a rotatably mounted inner cylinder 3. Cylinder 3 is provided with a circular bore 5 running longitudinally along and at a suitable radius about the central axis of the inner cylinder 3 to form a central post 4 of a suitable diameter so that the axis of the post 4 runs congruous with the axis of the inner cylinder 3 and the stationary cylinder 2.

The inner cylinder 3 is provided with a plurality of bores 7, each bore being in alignment with and having one end communicative with a corresponding bore 6 in the stationary cylinder. The other end of each inner bore 7 is provided with a shoulder 8 and is communicative with the circular bore 5.

Figure 2:
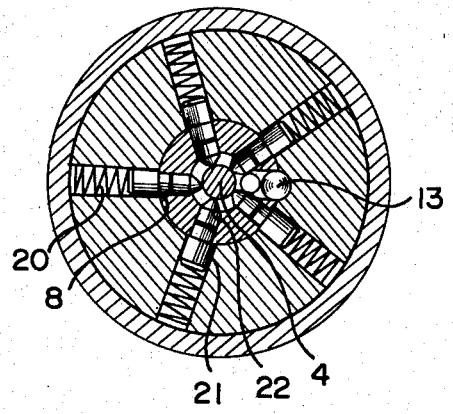
FIG. 2 is a view in cross section showing the position of the pin tumblers and ball when the cylinder lock is in a locked position.
Figure 4:
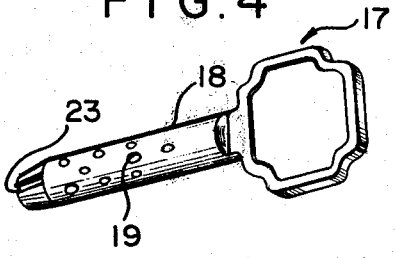
FIG. 4 is a perspective view of a key according to the present invention.

A plurality of pin tumblers 22 of various lengths and diameters are provided, one pin tumbler 22 being disposed in each inner bore 7. As shown in the drawings, each pin tumbler 22 ends in a rounded head **22*a* which extends into the circular bore 5. As shown in FIGS. 1 and 2, a back plug 21 generally T shaped is provided which plug extends between the inner bore 7 and the outer bore 6. A coil spring 20 is disposed in the outer bore 6 and extends between the housing 1 and the plug 21, thereby exerting pressure on the plug 21 and the pin tumbler 22 towards the common central axis of the outer and inner cylinders 2 and 3** respectively.

In addition, a key post 9 is disposed between the center post 4 and the stationary cylinder 2. As shown in the drawings, key post 9 is located near the closed end of central bore 5 and extends radially from the central axis of cylinders 2 & 3.

FIGS. 1 and 2 show further arrangement for making it more difficult to pick this lock. At the rear end of the inner cylinder 3, there is provided a bore 11 extending radially from the central axis of the outer and inner cylinders 2 and 3, respectively. A circular recess 12 is provided at the rear end of the stationary cylinder 2. One end of the bore 11 is communicative with the circular recess 12, while the other end thereof is communicative with the circular bore 5. A ball 13 is situated within the space constituted by the recess 12 and the bore 11. Attention should be drawn to the fact that the size of the recess 12 is smaller than a half of the ball 13. Also as seen in FIG. 1, a bore 14 is provided at the rear end of the inner cylinder 3, extending longitudinally therealong. One end of the bore 14 is communicative with the circular bore 5, the other end thereof being closed. A pin tumbler 15 with a rounded or gradually tapered end is disposed in the bore 14. A coil spring 16 is disposed between the closed end of the bore 14 and the pin tumbler 15, thereby exerting pressure on the pin tumbler 15 towards the position where the recess 12 is occupied by the ball 13, i.e., the ball 13 is urged by the pin tumbler 15 and is thereby clamped between the inner cylinder 3 and the outer cylinder 2.

A lock constructed in accordance with the above requires a key that is adapted to raise all of the radially disposed pin tumblers 22 to the correct height, and simultaneously push the longitudinally disposed pin tumbler 15 backward into the bore 14. Furthermore, the round shank 18 is hollow.

Figure 3:
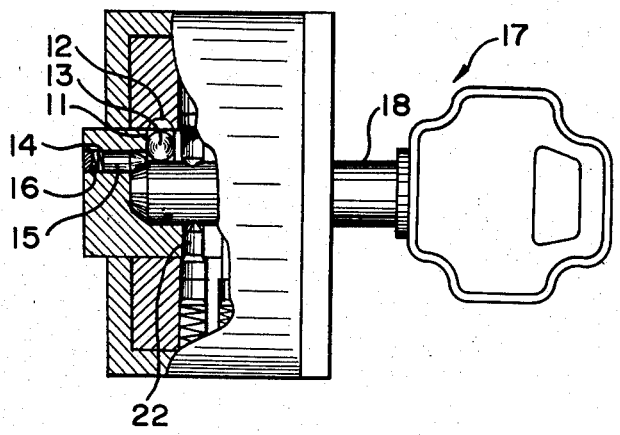
FIG. 3 is a view in partial longitudinal section showing the cooperative engagement of a key and cylinder lock according to the present invention.

Along the outer circumference of the shank 18 of the key 17 is provided a plurality of depressions 19 which correspond to the pin tumblers 22, such depressions being of various diameters and depths so as to correspond with tumblers 22 having various diameters and depths. When the key 17 is inserted into the lock 10 as shown in FIG. 3, the tubular shaft 16 rides over the center post 4. The leading edge of the shank 18 of the key 17 is tapered so that as the key 17 is inserted over the center post 4 the heads **22*a* of pin tumblers 22 are urged gently upwardly. As the key 17 is fully inserted, all the heads 22*a* of pin tumblers 22 fall over the surface of the key shank 18 and the longitudinally disposed pin tumbler 15 retreats into the bore 14. When the longitudinally disposed pin tumbler 15 retreats into the bore 14, the ball 13 falls radially inward until it is no longer clamped between the inner cylinder 3 and the outer cylinder 2. The key 17 is inserted into the circular bore 5 and over the center post 4 until a notch or indentation 18 meshes with the key post 9. In this way, exact positioning of the key 17 is obtained so that correct correspondence between the key depressions 19 and the various pin tumblers 22, and the meshing of the indentation 23 of key shank 18 with the key post 9 are assured. It is also by virtue of the retreating of the longitudinally disposed pin tumbler 15 into the bore 14 i.e. the radially inward falling of the ball 13 away from the separating line between the inner cylinder 3 and the outer cylinder 2 that enables the key, when turned, to cause the inner cylinder 3** to rotate.

As shown in FIG. 2, in the locked position each pin tumbler 22 is in its most forward position and rotation of the inner cylinder 3 is prevented as the back plugs 21 are positioned between the stationary cylinder 2 and inner cylinder 3. The locked position of this invention is further obtained by the ball 13 which is clamped between the stationary cylinder 2 and inner cylinder 3 by the pin tumbler 15. However, upon insertion of a matching key 17 as shown in FIG. 3, each pin tumbler 22 is raised by the depressions 19 to a point where the top of each pin tumbler 22 is flush with the outer surface of the rotably mounted inner cylinder 3 and the longitudinally disposed pin tumbler 15 is urged backward to a point where the ball 13 falls away from the circular recess 12, so that the inner cylinder 3 may be rotated as indentation 23 engages key post 9 as the key is rotated. It is noted that by using tumblers and depressions having different lengths and diameters, a large number of combination (or codes) becomes available. As a result, the present lock is extremely difficult to pick.

What I claim is:

1. An improved construction for a cylinder lock adapted to be selectively opened or locked by means of a matching key, comprising an inner and a stationary outer cylinder, said outer cylinder being provided in a suitable housing, said inner cylinder being rotatably mounted in said outer cylinder, a plurality of bores provided through said cylinders and arranged radially from the central axis of said inner cylinder, a plurality of radial pin tumblers of various lengths and diameters being provided one each in each radial bore, a plurality of back plugs, each back plug being provided behind a radial pin tumbler in said bores, a plurality of spring means, one spring means being provided between said housing and each said back plug to urge said radially disposed pin tumblers toward the axis of said inner cylinder, a radial bore being additionally provided at the rearmost portion of said inner cylinder, a circular recess being provided at the rearmost portion of said outer stationary cylinder, a ball being provided within the chamber constituted by said rearmost radial bore and said circular recess, the size of said circular recess being smaller than a half of the diameter of said ball, a longitudinal bore being provided in said longitudinal bore, a longitudinal spring means being provided between the bottom of said inner cylinder and longitudinal pin tumbler to urge said longitudinal pin tumbler to cause said ball to be clamped in the cavity between the inner and outer cylinders, a center post being longitudinally provided in said inner cylinder to constitute a circular central bore therebetween, a key post being provided in said circular central bore and disposed between said center post and the inner surface of said inner cylinder so that when said matching key is inserted into said circular central bore, each of the plurality of radial pin tumblers will be raised by the correct amount to the top thereof and being exactly flush with the outer surface of the inner cylinder, and the longitudinal pin tumbler will be urged backward to allow the clamped ball to fall away from the cavity in the outer cylinder, and by engagement of the key with said key post the inner cylinder will rotate in response to mutual rotation of said key, said matching key being characterized in that the shank thereof is round, hollow, and of approximately the same diameter as the inside diameter of said circular central bore so that said key may be inserted over said center post, said matching key being provided with a plurality of depressions of various diameters and depths, each depression corresponding to one of said plurality of radial pin tumblers and adapted for raising each of said radial pin tumblers the correct amount to effect opening of said lock, and the end of said shank being tapered and having disposed therein an indentation for engaging with a key post provided in said lock.

* * * * *